US012359450B2

(12) United States Patent
Cruz

(10) Patent No.: US 12,359,450 B2
(45) Date of Patent: Jul. 15, 2025

(54) SCAFFOLD SAFETY ASSEMBLY

(71) Applicant: Joao Paulo Cruz, King City (CA)

(72) Inventor: Joao Paulo Cruz, King City (CA)

( * ) Notice: Subject to any disclaimer, the term of this patent is extended or adjusted under 35 U.S.C. 154(b) by 918 days.

(21) Appl. No.: 17/523,642

(22) Filed: Nov. 10, 2021

(65) Prior Publication Data

US 2023/0141343 A1 May 11, 2023

(51) Int. Cl.

| | |
|---|---|
| ***E04G 5/14*** | (2006.01) |
| ***E04G 5/10*** | (2006.01) |
| *E04G 1/00* | (2006.01) |
| *E04G 5/08* | (2006.01) |

(52) U.S. Cl.

CPC ..... *E04G 5/14* (2013.01); *E04G 5/10* (2013.01); *E04G 1/00* (2013.01); *E04G 5/08* (2013.01); *E04G 5/144* (2013.01)

(58) Field of Classification Search

CPC .... E04G 5/14; E04G 5/10; E04G 1/00; E04G 5/061; E04G 5/144; E04G 5/08

See application file for complete search history.

(56) References Cited

U.S. PATENT DOCUMENTS 1,042,192 A * 10/1912 Boilot ..... E06C 7/16 248/238
3,726,362 A * 4/1973 Puckett ..... E04G 1/14 182/178.6
3,863,899 A * 2/1975 Werner ..... E04H 17/165 182/113
4,424,949 A * 1/1984 Kimmett ..... B05C 21/00 220/478
4,565,261 A 1/1986 Maier
4,869,343 A * 9/1989 Anderson ..... E04G 5/14 182/113
4,953,661 A * 9/1990 Hilton ..... E06C 7/14 182/120
4,979,710 A * 12/1990 Baldwin ..... E06C 7/14 248/210
5,020,757 A * 6/1991 Sulecki ..... E04G 5/065 248/500
5,052,515 A * 10/1991 Nowlan ..... E06C 7/16 182/121
5,103,658 A * 4/1992 McQuade ..... E05C 3/06 49/394
5,170,552 A 12/1992 Swiderski
5,388,665 A * 2/1995 Newman ..... E06C 7/16 182/118
5,431,249 A * 7/1995 Tredup ..... E06C 7/14 248/210

(Continued)

FOREIGN PATENT DOCUMENTS

GB 2538349 11/2016

*Primary Examiner* — Phi D A

(57) ABSTRACT

A scaffold safety assembly for facilitating a worker to service a scaffold includes a scaffold that has a frame comprising a leg portion. A step unit is removably attachable to the leg portion of the frame of the scaffold to facilitate a worker to stand on the step unit. The step unit extends laterally away from the leg portion when the step unit is removably attached to the leg portion. In this way the gate facilitates the worker to access various areas of the scaffold without standing on the scaffold. A gate is removably attachable to the leg portion of the frame of the scaffold. Additionally, the gate is positionable adjacent to the platform to inhibit the worker from falling off of the platform.

13 Claims, 6 Drawing Sheets

(56) References Cited

U.S. PATENT DOCUMENTS 5,460,241 A * 10/1995 LaBelle ..... E06C 7/16 182/121
6,003,630 A * 12/1999 Whalen ..... E04G 5/067 248/235
6,394,227 B1 5/2002 Frestad
6,601,674 B2 * 8/2003 Murray ..... E04G 5/00 248/238
6,840,350 B2 * 1/2005 Deal ..... E06C 7/44 182/150
6,966,406 B2 11/2005 Nash, Jr.
7,832,148 B2 11/2010 Stoffels
7,857,097 B2 * 12/2010 Evinger ..... E04G 3/28 182/136
7,887,016 B2 * 2/2011 Gunsaullus ..... E06C 7/14 182/2.1
8,047,330 B1 * 11/2011 English ..... E06C 7/48 182/117
8,776,947 B1 * 7/2014 Wurth ..... E06C 7/48 182/1
8,979,053 B2 * 3/2015 Deal ..... E06C 7/48 248/237
9,051,746 B2 * 6/2015 Rogers ..... E04G 5/08
9,677,336 B2 6/2017 Najey
9,890,589 B2 * 2/2018 Goodnow ..... E06C 7/16
10,006,248 B2 * 6/2018 Goodnow ..... E06C 7/16
10,119,332 B1 * 11/2018 Schellens ..... E06C 7/14
10,731,415 B2 * 8/2020 Desjardine ..... E06C 7/14
10,844,661 B1 11/2020 Halloran
11,180,222 B2 * 11/2021 Sabow ..... E06C 7/081
11,492,813 B2 * 11/2022 Fearon ..... E04G 5/147
2010/0288583 A1 * 11/2010 Becker ..... E04G 3/24 182/128
2014/0326538 A1 * 11/2014 Najey ..... E06C 7/08 182/129

* cited by examiner

SCAFFOLD SAFETY ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to safety devices and more particularly pertains to a new safety device for facilitating a worker to service a scaffold. The device includes a step unit which includes a platform and a series of brackets that engages a frame of a scaffold.

In this way a worker can stand on the platform to service the scaffold. The device includes a gate that engages the frame of the scaffold and which is positionable above the step unit. In this way the gate inhibits the worker from inadvertently falling off of the step unit.

(2) DESCRIPTION OF RELATED ART INCLUDING INFORMATION DISCLOSED UNDER 37 CFR 1.97 AND 1.98

The prior art relates to safety devices including a gallery device that includes platform that is attachable to a vertical surface to facilitate a worker to stand on the platform. The gallery device includes a balustrade that extends upwardly from the platform and a gate that is pivotally disposed on the balustrade. The prior art discloses a safety railing device that is attachable to a platform for inhibiting a worker from inadvertently stepping off of the platform. The prior art discloses a climbing device that is structured to resemble a ladder. The prior art discloses a scaffold device that includes a platform that is vertically adjustable along a pair of vertical rails. The prior art discloses a variety of ladder steps that is attachable to a rung of a ladder.

Brief Summary of the Invention

An embodiment of the disclosure meets the needs presented above by generally comprising a scaffold that has a frame comprising a leg portion. A step unit is removably attachable to the leg portion of the frame of the scaffold to facilitate a worker to stand on the step unit. The step unit extends laterally away from the leg portion when the step unit is removably attached to the leg portion. In this way the gate facilitates the worker to access various areas of the scaffold without standing on the scaffold. A gate is removably attachable to the leg portion of the frame of the scaffold. Additionally, the gate is positionable adjacent to the platform to inhibit the worker from falling off of the platform.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
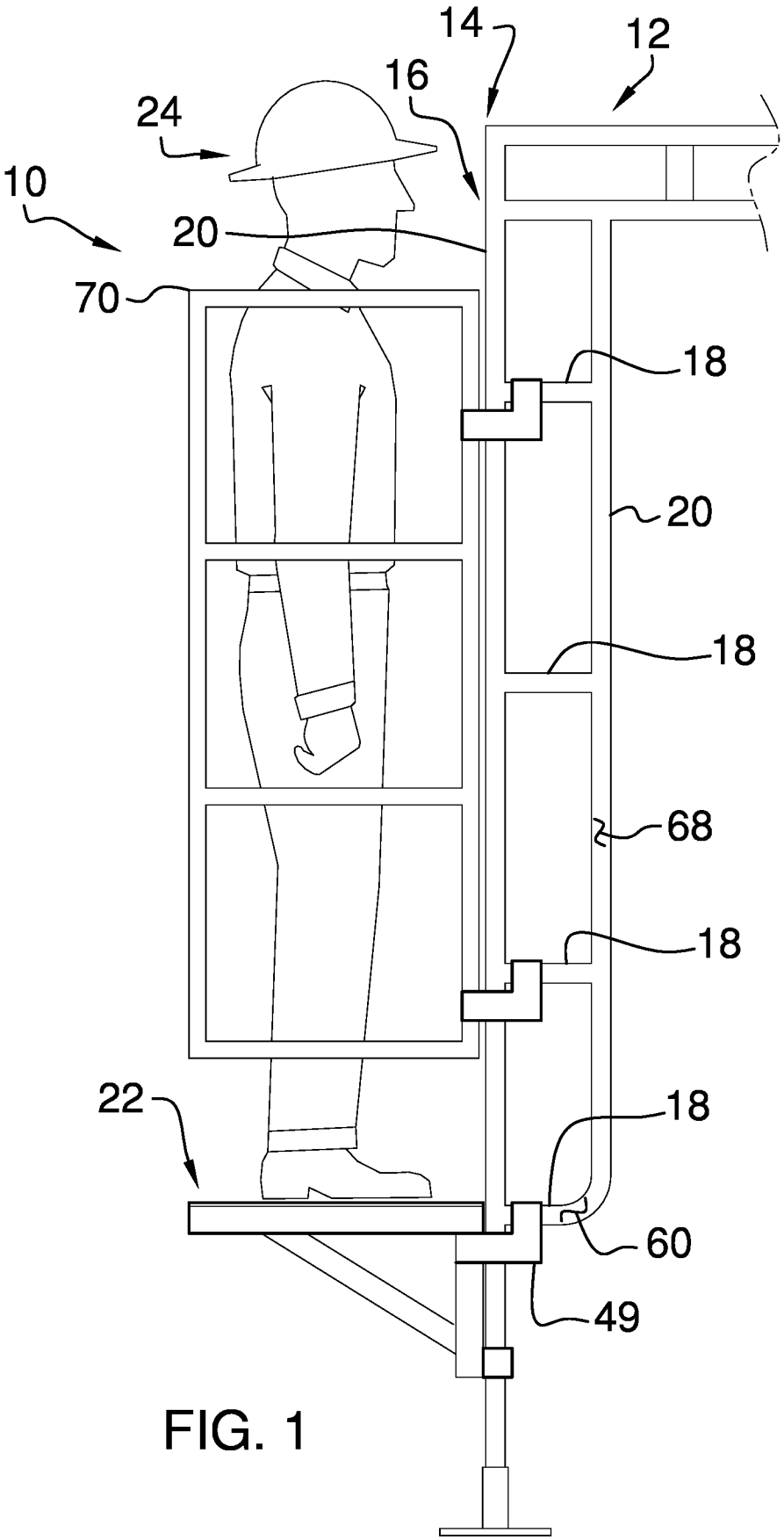
FIG. 1 is a perspective in-use view of a scaffold safety assembly according to an embodiment of the disclosure.
Figure 2:
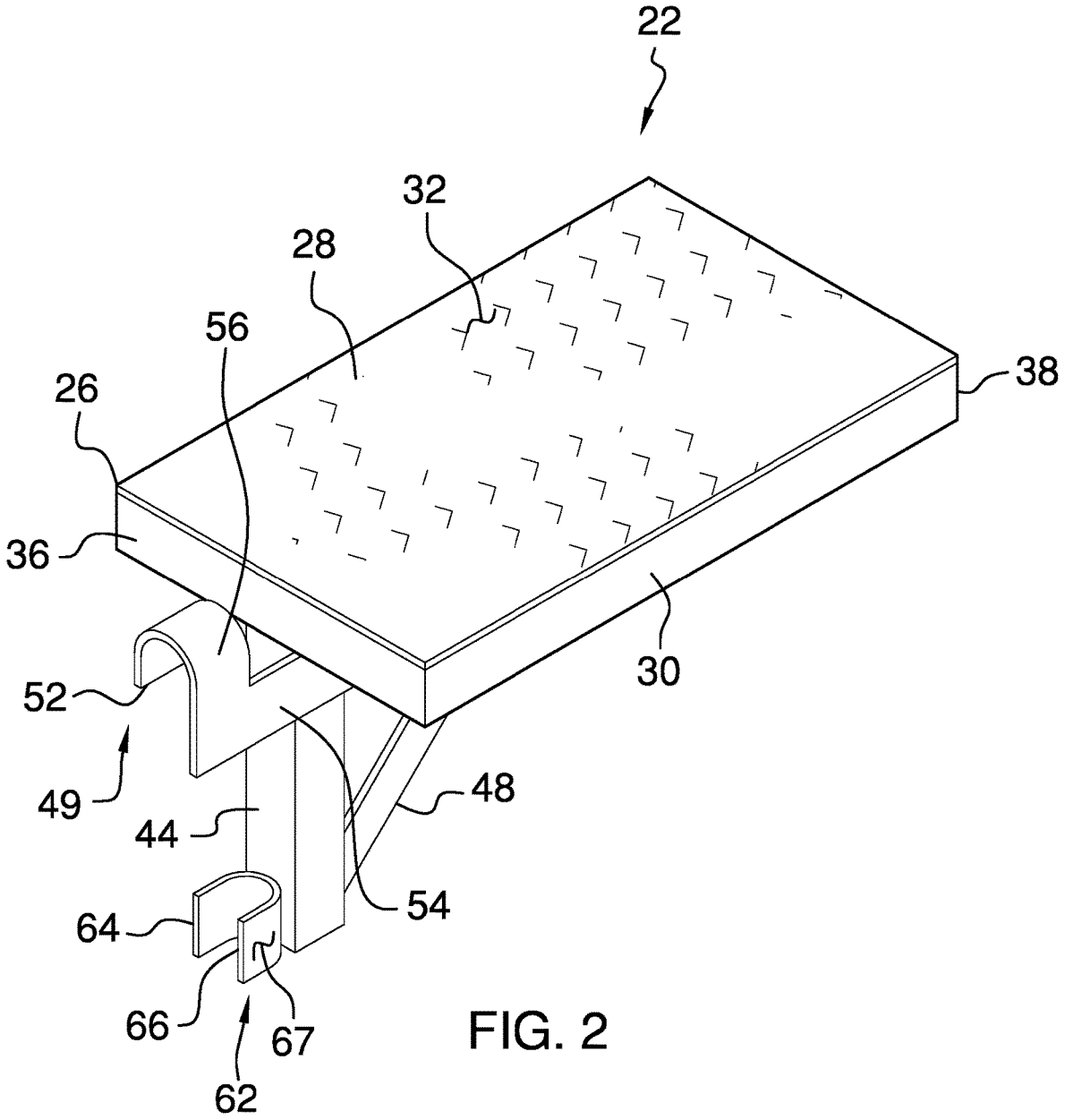
FIG. 2 is a top perspective view of a step unit of an embodiment of the disclosure.
Figure 3:
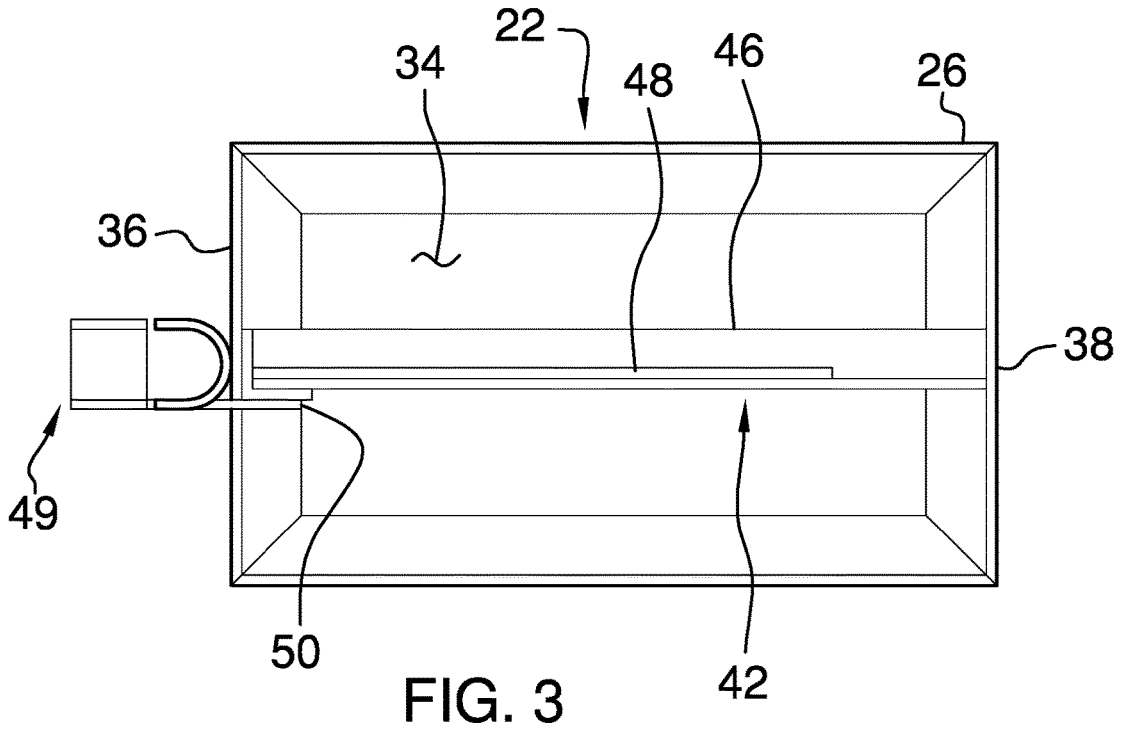
FIG. 3 is a bottom view of a step unit of an embodiment of the disclosure.
Figure 4:
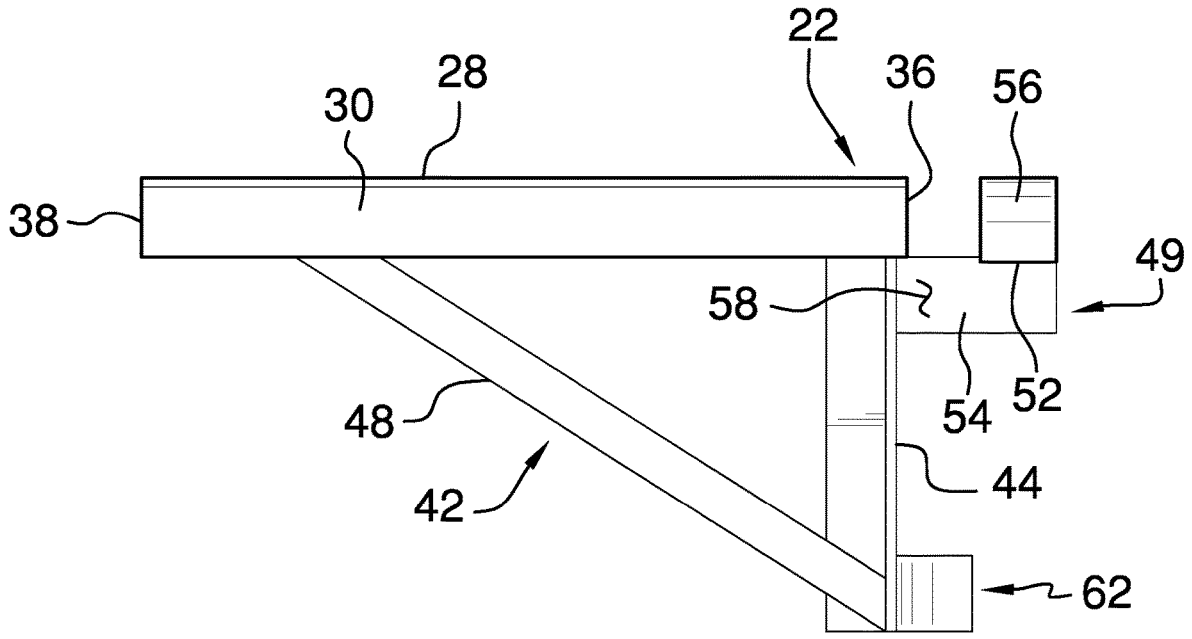
FIG. 4 is a left side view of a step unit of an embodiment of the disclosure.
Figure 5:
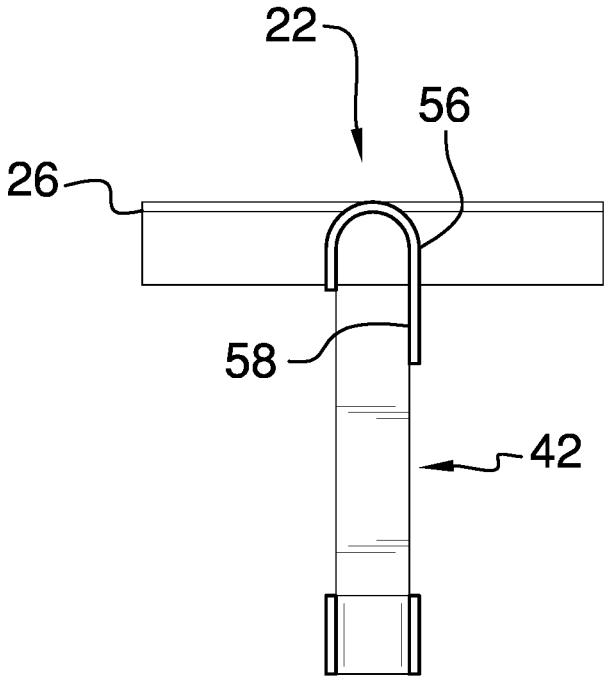
FIG. 5 is a front view of a step unit of an embodiment of the disclosure.
Figure 6:
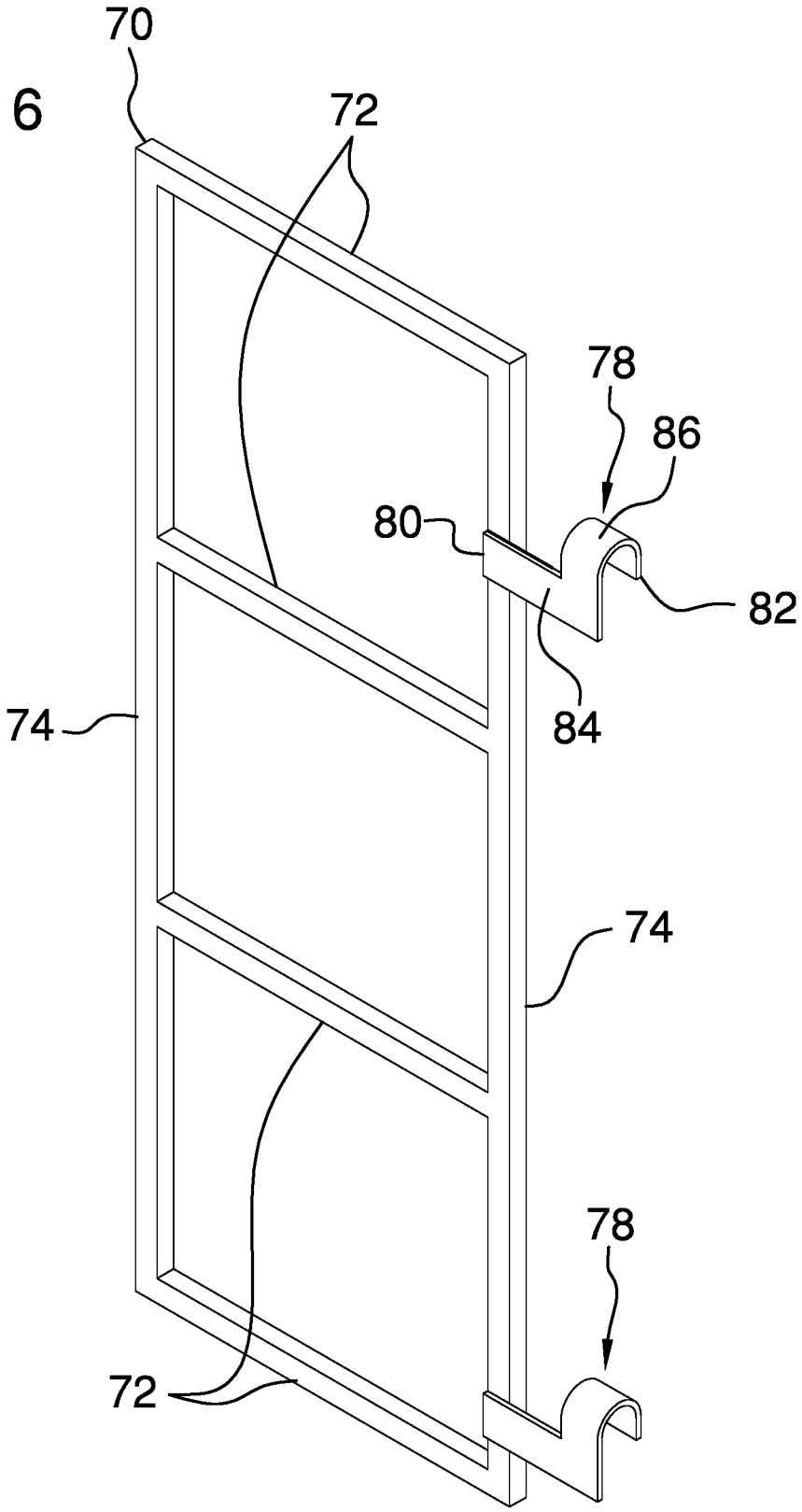
FIG. 6 is a perspective view of a gate of an embodiment of the disclosure.
Figure 7:
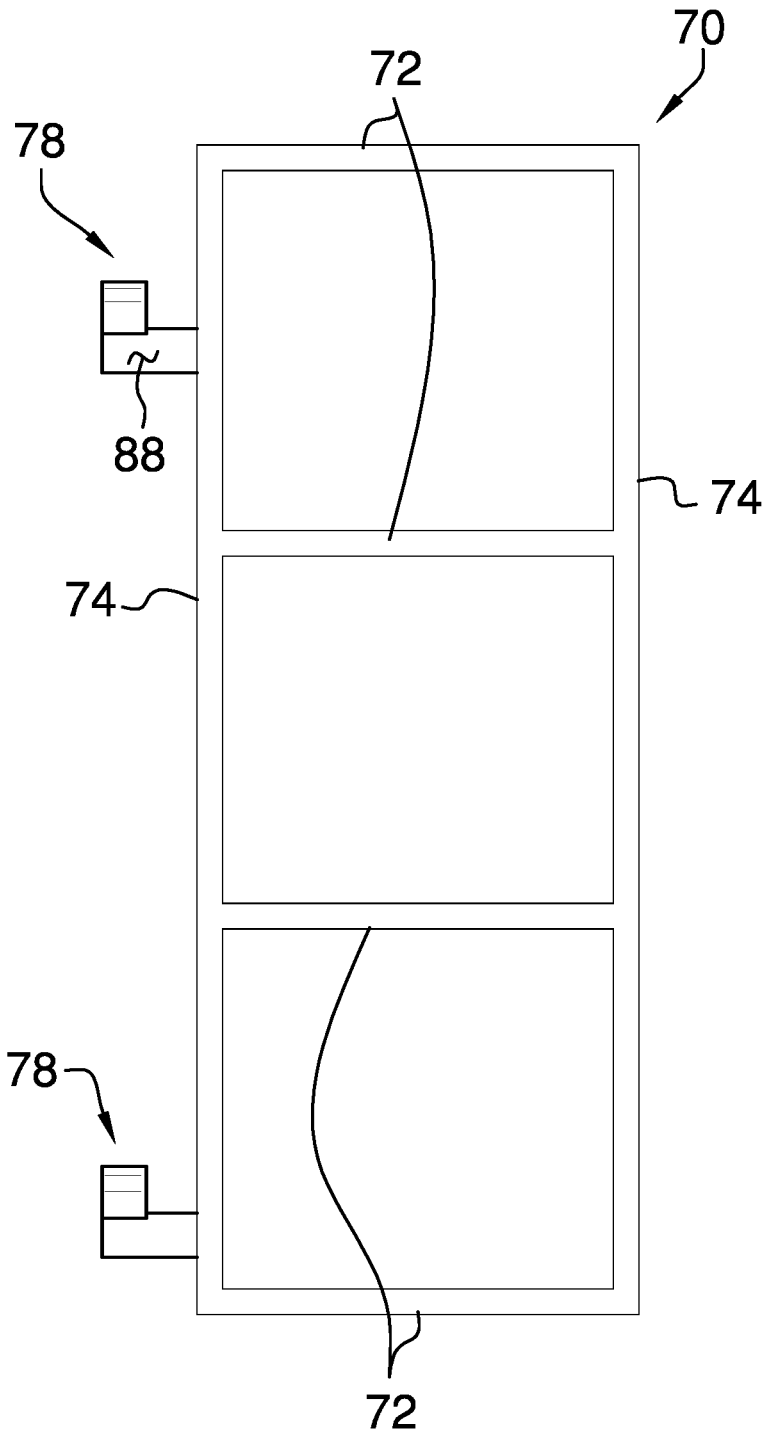
FIG. 7 is a back view of a gate of an embodiment of the disclosure.

With reference now to the drawings, and in particular to FIGS. 1 through 7 thereof, a new safety device embodying the principles and concepts of an embodiment of the disclosure and generally designated by the reference numeral 10 will be described.

As best illustrated in FIGS. 1 through 7, the scaffold safety assembly 10 generally comprises a scaffold 12 has a frame 14 comprising a leg portion 16 which includes a plurality of horizontal members 18 extending between a pair of vertical members 20. A step unit 22 is removably attachable to the leg portion 16 of the frame 14 of the scaffold 12 to facilitate a worker 24 to stand on the step unit 22. Furthermore, the step unit 22 extends laterally away from the leg portion 16 when the step unit 22 is removably attached to the leg portion 16. In this way the step unit 22 facilitates the worker 24 to access various areas of the scaffold 12 without standing on the scaffold 12. Thus, the worker 24 can install walking planks, for example, on top of the scaffold 12 without having to climb or stand on the frame 14 of the scaffold 12.

The step unit 22 comprises a platform 26 that has a top wall 28 and a perimeter wall 30 extending downwardly from the top wall 28. The top wall 28 has an upper surface 32 and a lower surface 34, and the upper surface 32 is textured to enhance traction on the upper surface 32. The perimeter wall 30 has a first lateral side 36 and a second lateral side 38, and the platform 26 is elongated between the first lateral side 36 and the second lateral side 38. The step unit 22 includes a bracket 42 that has a first member 44, a second member 46 that is perpendicularly oriented with the first member 44 and a third member 48 that extends diagonally between the first member 44 and the second member 46 such that the bracket 42 defines a right triangle. The second member 46 is attached to the lower surface 34 of the top wall 28 having the second member 46 extending between the first lateral side 36 and the second lateral side 38 of the perimeter wall 30. Additionally, the first member 44 extends downwardly from the lower surface 34 of the top wall 28.

The step unit 22 includes a platform support 49 that has a first end 50 and a second end 52. The platform support 49 has a first portion 54 that is perpendicularly oriented with a second portion 56. The first end 50 is associated with the first portion 54 and the second end 52 is associated with the second portion 56. The second portion 56 is curved between the first portion 54 and the second end 52 such that the second end 52 is directed downwardly toward the first portion 54. A first surface 58 of the first portion 54 is coupled to the first member 44 such that the platform support 49 extends outwardly beyond the first lateral side 36 of the perimeter wall 30. Additionally, the second portion 56 extends upwardly beyond the top wall 28 of the platform 26.

The second portion 56 rests on a respective one of the horizontal members 18 of the leg portion 16 of the scaffold 12 having a curvature of the second portion 56 conforming to an outer surface 60 of the respective horizontal member 18. In this way the platform 26 can support the weight of the worker 24 when the worker 24 stands on the platform 26. The step unit 22 includes a grapple 62 that has a primary end 64, a secondary end 66 and an outer surface 67 extending between the primary end 64 and the secondary end 66. The outer surface 67 is curved between the primary end 64 and the secondary end 66, and the primary end 64 is spaced from the secondary end 66 such that the grapple 62 forms a U-shape.

The outer surface of the grapple 62 is coupled to the first member 44 having the grapple 62 being positioned beneath the platform support 49. Each of the primary end 64 and the secondary end 66 is directed away from the first member 44 in the same direction that the first portion 54 of the platform support 49 extends from the first member 44. The grapple 62 conforms to an outer surface 68 of a respective one of the horizontal members 18 of the leg portion 16 of the scaffold 12 such that the platform 26 is retained on a horizontal plane.

A gate 70 is removably attachable to the leg portion 16 of the frame 14 of the scaffold 12. The gate 70 is positionable adjacent to the platform 26 to inhibit the worker 24 from falling off of the platform 26. The gate 70 comprises a plurality of first members 72 each extending between a pair of second members 74. Additionally, each of the first members 72 of the gate 70 is perpendicularly oriented with the second members 74 of the gate 70 such that the gate 70 has a rectangular shape. The first members 72 of the gate 70 are spaced apart from each other and are distributed along a full length of the second members 74 of the gate 70.

A pair of a gate supports 78 is provided and each of the gate supports 78 has a primary end 80 and a secondary end 82. Each of the gate supports 78 has a primary portion 84 that is perpendicularly oriented with a secondary portion 86. The primary end 64 of the gate supports 78 is associated with the primary portion 84 and the secondary end 66 of the gate supports 78 is associated with the secondary portion 86. The secondary portion 86 is curved between the primary portion 84 and the secondary end 82 of the gate supports 78 such that the secondary end 82 of the gate supports 78 is directed downwardly toward the primary portion 84. Moreover, a primary surface 88 of the primary portion 84 each of the gate supports 78 is coupled to a respective one of the second members 74 of the gate 70 such that each of gate supports 78 extends laterally away from the respective second member 74 of the gate 70.

Each of the gate supports 78 is positioned adjacent to opposing ends of the respective second member 74 of the gate 70. Furthermore, the secondary portion 86 rests on a respective one of the horizontal members 18 of the leg portion 16 of the scaffold 12. Additionally, a curvature of the secondary portion 86 conforms to the outer surface 68 of the respective horizontal member 18. The gate 70 is positioned above the platform 26 when the platform 26 and the gate 70 are removably attached to the scaffold 12.

In use, the step unit 22 is positioned at a desired height on the leg portion 16 of the frame 14 of the scaffold 12. In this way the worker 24 can stand on the platform 26 of the step unit 22 to assemble additional stories to the scaffold 12, install walking planks on the scaffold 12, or perform any other service or maintenance procedures on the scaffold 12. The gate 70 is positioned at a desired location on the leg portion 16 such that the gate 70 is positioned above the step unit 22. In this way the gate 70 enhances safety for the worker 24 by inhibiting the worker 24 from inadvertently stepping off of the step unit 22.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A scaffold safety assembly for facilitating an auxiliary step and gate to be removably attached to an existing scaffold, said assembly comprising;

a scaffold having a frame comprising a leg portion, said leg portion including a plurality of horizontal members extending between a pair of vertical members;

a step unit being removably attachable to said leg portion of said frame of said scaffold wherein said step unit is configured to facilitate a worker to stand on said step unit, said step unit extending laterally away from said leg portion when said step unit is removably attached to said leg portion wherein said step unit is configured to facilitate the worker to access various areas of the scaffold without standing on the scaffold;

a gate being removably attachable to said leg portion of said frame of said scaffold, said gate being positionable adjacent to said platform wherein said gate is configured to inhibit the worker from falling off of said platform; and wherein said step unit includes a platform support having a first end and a second end, said platform support having a first portion being perpendicularly oriented with a second portion, said first end being associated with said first portion, said second end being associated with said second portion, said second portion being curved between said first portion and said second end such that said second end is directed downwardly toward said first portion.

2. The assembly according to claim 1, wherein said step unit comprises a platform having a top wall and a perimeter wall extending downwardly from said top wall, said top wall having an upper surface and a lower surface, said top surface being textured wherein said top surface is configured to enhance traction on said top surface, said perimeter wall having a first lateral side and a second lateral side, said platform being elongated between said first lateral side and said second lateral side.

3. A scaffold safety assembly for facilitating an auxiliary step and gate to be removably attached to an existing scaffold, said assembly comprising:

a scaffold having a frame comprising a leg portion, said leg portion including a plurality of horizontal members extending between a pair of vertical members;

a step unit being removably attachable to said leg portion of said frame of said scaffold wherein said step unit is configured to facilitate a worker to stand on said step unit, said step unit extending laterally away from said leg portion when said step unit is removably attached to said leg portion wherein said step unit is configured to facilitate the worker to access various areas of the scaffold without standing on the scaffold;

a gate being removably attachable to said leg portion of said frame of said scaffold, said gate being positionable adjacent to said platform wherein said gate is configured to inhibit the worker from falling off of said platform;

wherein said step unit comprises a platform having a top wall and a perimeter wall extending downwardly from said top wall, said top wall having an upper surface and a lower surface, said top surface being textured wherein said top surface is configured to enhance traction on said top surface, said perimeter wall having a first lateral side and a second lateral side, said platform being elongated between said first lateral side and said second lateral side; and wherein said step unit includes a bracket having a first member, a second member being perpendicularly oriented with said first member and a third member extending diagonally between said first member and said second member such that said bracket defines a right triangle, said second member being attached to said lower surface of said top wall having said second member extending between said first lateral side and said second lateral side of said perimeter wall, said first member extending downwardly from said lower surface of said top wall.

4. The assembly according to claim 1, wherein:

said step unit includes a bracket having a first member; and a first surface of said first portion is coupled to said first member such that said platform support extends outwardly beyond said first lateral side of said perimeter wall having said second portion extending upwardly beyond said top wall of said platform.

5. The assembly according to claim 1, wherein said second portion rests on a respective one of said horizontal members of said leg portion of said scaffold having a curvature of said second portion conforming to an outer surface of said respective horizontal member wherein said platform is configured to support the weight of the worker when the worker stands on said platform.

6. The assembly according to claim 1, wherein said step unit includes a grapple having a primary end, a secondary end and an outer surface extending between said primary end and said secondary end, said outer surface being curved between said primary end and said secondary end, said primary end being spaced from said secondary end such that said grapple forms a U-shape.

7. The assembly according to claim 6, wherein:

said step unit includes a bracket having a first member;

said step unit includes a platform support having a first portion; and said outer surface of said grapple is coupled to said first member having said grapple being positioned beneath said platform support, each of said primary end and said secondary end being directed away from said first member in the same direction that said first portion of said platform support extends from said first member.

8. The assembly according to claim 5, wherein:

said step unit includes a platform; and said grapple conforms to an outer surface of a respective one of said horizontal members of said leg portion of said scaffold such that said platform is retained on a horizontal plane.

9. The assembly according to claim 1, wherein said gate comprises a plurality of first members each extending between a pair of second members, each of said first members being perpendicularly oriented with said second members such that said gate has a rectangular shape, said first members being spaced apart from each other and being distributed along a full length of said second members.

10. The assembly according to claim 1, further comprising a pair of a gate supports, each of said gate supports having a primary end and a secondary end, each of said gate supports having a primary portion being perpendicularly oriented with a secondary portion, said primary end being associated with said primary portion, said secondary end being associated with said secondary portion, said secondary portion being curved between said primary portion and said secondary end such that said secondary end is directed downwardly toward said primary portion.

11. The assembly according to claim 10, wherein a primary surface of said primary portion each of said gate supports is coupled to a respective one of said second members of said gate such that said each of gate supports extends laterally away from said respective second member.

12. A scaffold safety assembly for facilitating an auxiliary step and gate to be removably attached to an existing scaffold, said assembly comprising:

a scaffold having a frame comprising a leg portion, said leg portion including a plurality of horizontal members extending between a pair of vertical members;

a step unit being removably attachable to said leg portion of said frame of said scaffold wherein said step unit is configured to facilitate a worker to stand on said step unit, said step unit extending laterally away from said leg portion when said step unit is removably attached to said leg portion wherein said step unit is configured to facilitate the worker to access various areas of the scaffold without standing on the scaffold;

a gate being removably attachable to said leg portion of said frame of said scaffold, said gate being positionable adjacent to said platform wherein said gate is configured to inhibit the worker from falling off of said platform;

a pair of a gate supports, each of said gate supports having a primary end and a secondary end, each of said gate supports having a primary portion being perpendicularly oriented with a secondary portion, said primary end being associated with said primary portion, said secondary end being associated with said secondary portion, said secondary portion being curved between said primary portion and said secondary end such that said secondary end is directed downwardly toward said primary portion; and wherein each of said gate supports is positioned adjacent to opposing ends of said respective second member, said secondary portion resting on a respective one of said horizontal members of said leg portion of said scaffold having a curvature of said secondary portion conforming to an outer surface of said respective horizontal member.

13. The scaffold safety assembly according to claim 1, further comprising:

said step unit comprising:

a platform having a top wall and a perimeter wall extending downwardly from said top wall, said top wall having an upper surface and a lower surface, said top surface being textured wherein said top surface is configured to enhance traction on said top surface, said perimeter wall having a first lateral side and a second lateral side, said platform being elongated between said first lateral side and said second lateral side;

a bracket having a first member, a second member being perpendicularly oriented with said first member and a third member extending diagonally between said first member and said second member such that said bracket defines a right triangle, said second member being attached to said lower surface of said top wall having said second member extending between said first lateral side and said second lateral side of said perimeter wall, said first member extending downwardly from said lower surface of said top wall;

said a first surface of said first portion being coupled to said first member such that said platform support extends outwardly beyond said first lateral side of said perimeter wall having said second portion extending upwardly beyond said top wall of said platform, said second portion resting on a respective one of said horizontal members of said leg portion of said scaffold having a curvature of said second portion conforming to an outer surface of said respective horizontal member wherein said platform is configured to support the weight of the worker when the worker stands on said platform; and a grapple having a primary end, a secondary end and an outer surface extending between said primary end and said secondary end, said outer surface being curved between said primary end and said secondary end, said primary end being spaced from said secondary end such that said grapple forms a U-shape, said outer surface of said grapple being coupled to said first member having said grapple being positioned beneath said platform support, each of said primary end and said secondary end being directed away from said first member in the same direction that said first portion of said platform support extends from said first member, said grapple conforming to an outer surface of a respective one of said horizontal members of said leg portion of said scaffold such that said platform is retained on a horizontal plane; and said gate comprising a plurality of first members each extending between a pair of second members, each of said first members being perpendicularly oriented with said second members such that said gate has a rectangular shape, said first members being spaced apart from each other and being distributed along a full length of said second members; and a pair of a gate supports, each of said gate supports having a primary end and a secondary end, each of said gate supports having a primary portion being perpendicularly oriented with a secondary portion, said primary end being associated with said primary portion, said secondary end being associated with said secondary portion, said secondary portion being curved between said primary portion and said secondary end such that said secondary end is directed downwardly toward said primary portion, a primary surface of said primary portion each of said gate supports being coupled to a respective one of said second members of said gate such that said each of gate supports extends laterally away from said respective second member, each of said gate supports being positioned adjacent to opposing ends of said respective second member, said secondary portion resting on a respective one of said horizontal members of said leg portion of said scaffold having a curvature of said secondary portion conforming to an outer surface of said respective horizontal member, said gate being positioned above said platform when said platform and said gate are removably attached to said scaffold.

* * * * *